United States Patent [19]

Steidinger

[11] 3,988,971

[45] Nov. 2, 1976

[54] METHOD OF MAKING ENVELOPE ASSEMBLY

[75] Inventor: Donald J. Steidinger, Barrington, Ill.

[73] Assignee: Wallace Business Forms, Inc., Hillside, Ill.

[22] Filed: June 18, 1975

[21] Appl. No.: 587,990

Related U.S. Application Data

[63] Continuation-in-part of Ser. No. 366,153, June 1, 1973, abandoned.

[52] U.S. Cl. ..... 93/63 M; 93/61 R

[51] Int. Cl.[2] ..... B31B 1/16

[58] Field of Search ..... 93/63 M, 63 R, 61 R; 53/30, 31, 206; 229/69

[56] References Cited

UNITED STATES PATENTS

| | | | |
|---|---|---|---|
| 3,428,237 | 2/1969 | Dowen | 229/69 |
| 3,442,185 | 5/1969 | Buescher | 93/63 M |
| 3,580,488 | 5/1971 | Komen | 229/69 |
| 3,830,141 | 8/1974 | Steidinger | 93/63 M |
| 3,837,565 | 9/1974 | Johnsen | 229/69 X |
| 3,866,822 | 2/1975 | Faltin et al. | 229/69 |

*Primary Examiner*—James F. Coan

*Attorney, Agent, or Firm*—Dawson, Tilton, Fallon & Lungmus

[57] ABSTRACT

A method of making a mail piece construction including a series of interconnected envelope assemblies wherein each assembly includes a panel, the major portion of which constitutes the envelope front and flap and wherein a smaller discrete back is secured on three sides to the envelope front to provide a removable strip whereby the assembly is useful as a return envelope.

2 Claims, 3 Drawing Figures

METHOD OF MAKING ENVELOPE ASSEMBLY

This application is a continuation-in-part of my copending application Ser. No. 366,153, filed June 1, 1973 and now abandoned.

BACKGROUND AND SUMMARY OF INVENTION:

Elaborate machinery and procedures have been employed to produce envelopes in a continuous stream, i.e., with adjacent envelope assemblies interconnected to form a series. I have discovered that, by virtue of employing discrete envelope backs laid down on a continuous web equipped with line holes, a speedy and reliable envelope stream can be produced and, by spacing the envelope backs, a continuous stream of return envelopes can be provided which is readily integrated into a high speed mailer operation.

Other objects and advantages of the invention may be seen as this specification proceeds.

DETAILED DESCRIPTION OF INVENTION:

Figure 1:
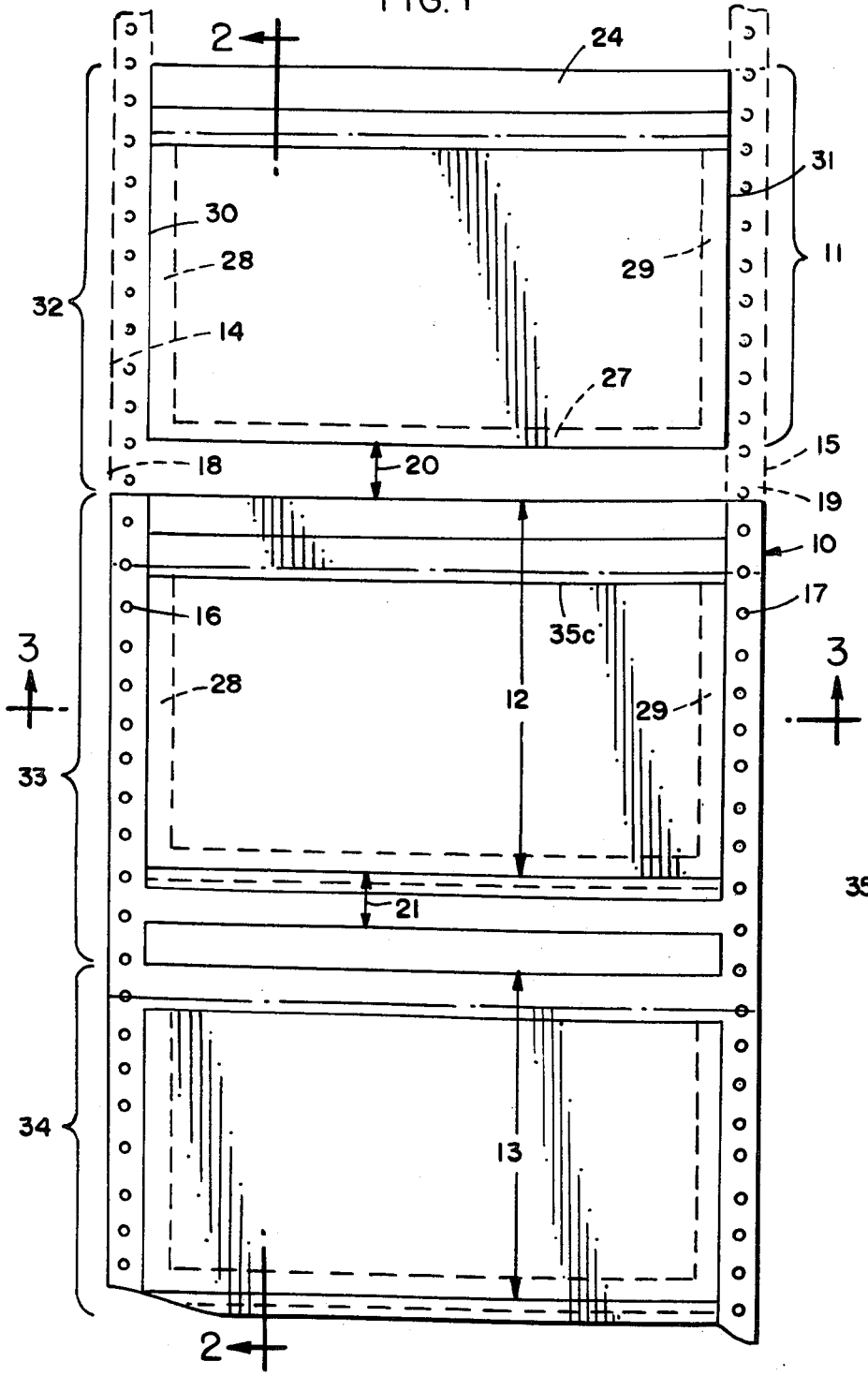
Figure 2:
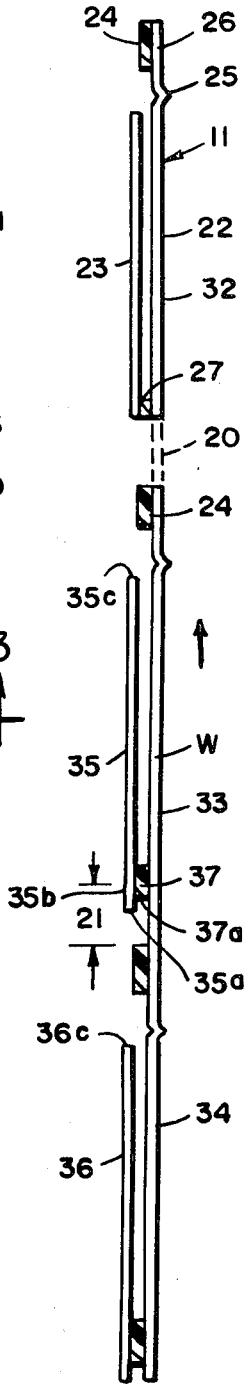
Figure 3:
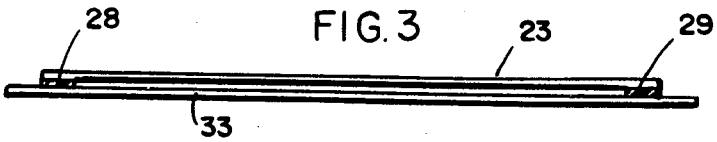

The invention is described in conjunction with the accompanying drawing, in which:

FIG. 1 is a plan view of a product produced according to the invention in which a series of interconnected envelopes is arranged in lay-flat condition and viewed from the rear, the initial envelope being detached from the series; and FIGS. 2 and 3 are sectional views taken along the sight lines 2—2 and 3—3 respectively, of FIG. 1.

In the illustration given, and with particular reference to FIG. 1, the numeral 10 designates a series of interconnected envelope assemblies. It will be appreciated that the invention contemplates continuous production of envelopes in an interconnected series or stream, but that only a portion of this stream is shown — for ease and clarity of presentation.

The final return envelope is designated 11 in FIG. 1, and this is depicted in detached form from the remainder of the stream 10. However, the envelope 11 is positioned relative to the remainder of the stream 10 in that position it would occupy had not trimming and punching have occurred. For example, the second envelope in the stream 10 depicted in FIG. 1 of the drawing is designated 12, while the third is designated 13. These are seen to be interconnected. The envelope 11 is useful as a return envelope in the stuffed, sealed envelope or mailer assemblies seen in U.S. Pat. Nos. 3,777,971 and 3,830,141.

To convert the envelope 12 to the condition of the envelope 11 it is necessary to remove the margins 14 and 15. Each of these margins is equipped with line holes as at 16 and 17, respectively, for advancing the web material ultimately constituting the front of the envelope through the various processing stages. Advantageously, the margins 14 and 15 are defined on their respective inner longitudinal edges by lines of weakness as at 18 and 19, respectively. For example, the lines of weakness 18 and 19 may take the form of longitudinally extending perforations. In any event, one of the removal steps incident to developing a final envelope involves the removal of the margins 14 and 15.

In the invention as illustrated in FIG. 1, another web removal operation is employed in the development of the final envelope 11. This involves the removal (as by punching, cutting, etc.) of a transversely extending strip 20 which is located between the longitudinally spaced-apart envelopes 11 and 12. In like fashion, to separate what will become the envelope 12, it is necessary to remove a transversely extending strip 21.

From the foregoing, it will be appreciated that not all of the web material being processed is employed to develop the final envelope; for example, the margins 14 and 15 require removal, as well as the transversely extending strips 20, 21, etc.

Referring now to the upper portion of FIGS. 1 and 2, the final envelope 11 is seen to include a front part 22 and a back part 23. The front part 22, at its forward portion, is equipped with a transversely extending band of adhesive 24. The band of adhesive 24, as shown, extends between the lines of weakness or trimming 18 and 19. Rearward (in the direction of movement of web W — see the arrow applied to FIG. 2 — during processing) of the adhesive band 24 is located a line of potential folding 25. Here it will be appreciated that the description of various portions of the envelope in terms of movement during processing is provided relative to the illustrated embodiment and is not to be construed as a limitation. For example, processing is equally feasible according to the trailing edge of an envelope as contrasted to the forward edge, as shown.

In the illustration given, the portion of the web forward of the line of potential folding is designated 26, and constitutes what becomes the flap part of the envelope.

The back part 23 of the envelope is adhered to the front part 22 by means of three bands of adhesive. These include an elongated band of adhesive 27 which secures the back part 23 to the front part 22, and which is spaced from but parallel to the line of potential folding 25. Additionally, I provide elongated bands of adhesive as at 28 and 29 along a pair of opposed side edges 30 and 31 of the back part 23. The adhesive bands 28 and 29 can be readily appreciated from a consideration of FIG. 3.

The numerals 32, 33, and 34 designate, respectively, interconnected front panels which are employed during the production of the inventive envelope assemblies, the major portion of each panel constituting the envelope front part 22 and the flap part 26. Each panel 32–34 further includes the web material to be removed, i.e., the margins 14 and 15 and the transversely extending strips, viz., the strip 20 relative to the panel 32, the strip 21 relative to the panel 33, etc.

In the production of the envelope assembly stream 10 seen in FIG. 1, a continuous web (designated W only in FIG. 2), and which includes front panels (as at 33 and 34), is advanced through a station where back panels 35 and 36 (see FIG. 2) are applied to the front panels 33 and 34. Here it should be appreciated that in the form of the invention depicted web material is removed from both the front and rear panels to develop the envelope front part 22 and the envelope back part 23. This can be readily appreciated from a consideration of the middle portion of FIG. 2. The transverse strip 21, which is removed by punching, cutting, etc., includes not only the trailing portion of the front panel 33, but a trailing portion of the rear panel 35. As seen in FIG. 2, the rear panel 35 is adhesively secured to the front panel 33 by means of a transversely extending band of adhesive 37, as well as the previously referred to longitudinally extending bands 28 and 29. More particularly, I have found it advantageous to position the band of adhesive 37 with its trailing edge, as at **37*a*, slightly forward of the trailing edge 35*a* of the rear panel 35. Ultimately, the portion 35*b* is removed as part of the transverse strip 21, resulting in an envelope 12** which is sealed along the very bottom.

It should be appreciated that in the removal of the web material, either the transverse strips 20, 21, etc. may be first removed, or the margins 14 and 15 may be removed, depending upon the character of the equipment utilized. In some instances, one of the margins 14, 15 can be retained on the envelope itself until the envelope is detached from the mailer form incident to being used as a return envelope. Alternatively, only one of the margins may be provided — it being possible to advance a web with only one set of line holes — as at 16.

In the practice of the invention, a continuous web W is advanced along a route of processing. For this purpose the web W is advantageously equipped with at least one of the longitudinal margins 14 or 15 and which is equipped with line holes 16 or 17, respectively. If it is desired to facilitate the development of an envelope flap, the web W may be transversely scored or otherwise varied to provide a line of potential folding 25. In any event, such a line will ultimately exist when the flap 26 is folded to bring the band of adhesive 24 into contact with envelope back part 23.

During the advancement of the web W through various processing stations, adhesive is advantageously laid down on the side of the web W ultimately facing the back 23. For example, spaced, transversely extending bands of adhesive 24, such as a water wettable adhesive, constituting the means for subsequently securing the flap to the back, can be laid down. Here, it should be appreciated that by the bands 24 I also include the use of a remoistenable adhesive over the entire back. Also, transversely-extending bands of adhesive 27 and 37, which are parallel to the aforementioned bands 24, may be laid down. Still further, bands of adhesive 28 and 29 extending at right angles to the aforementioned bands 24, 27, and 37, i.e., longitudinally are also laid down on the same face of the web W and in the portion constituting the front part 22. Thereafter the back panels 35, 36 are applied so as to overlie, for example, the bands of adhesive 37, 38 and 29 (relative to the assembly 12). The back panels 35–36 are aligned in the direction of processing, but are spaced from the back panels in adjacent assemblies.

What results from the foregoing is a series of interconnected envelope assemblies where each assembly has a front panel (as at 32–34), the major portion of which constitutes the envelope front part 22 and the flap part 26. The flap part 26 is defined relative to the front part 22 by a line of potential folding 25. Each assembly further includes a back panel, as at 35 or 36, at least the major portion of which constitutes the envelope back 23. A minor portion of the back panel 35 is trimmed, i.e., the portion designated **35*b* in the central portion of FIG. 2, to develop the envelope back 23**.

Each back panel 35 or 36 is positioned on its associated front panel 33 or 34, respectively. Each back panel 35 or 36 has two pairs of opposed side edges. One pair of side edges coincides approximately with the margin defining lines 30 and 31, while the other pair of opposed side edges is designated **35*a* and 35*c* (see the central portion of FIGS. 1 and 2). The portions of the back panel adjacent the first pair of opposed side edges (those corresponding approximately with the severance lines 30 and 31) are secured by bands of adhesive 28 and 29 to the front panel 33, 34**, etc.

An elongated band of adhesive, as at 37, secures the back panel 35 to the front panel 33, this band 37 being spaced from but parallel to the line of potential folding 25. In the case of the illustrated embodiment, the band 37 has its rear edge **37*a* spaced forwardly of the rear edge 35*a* of the back panel 35. One side edge as at 36*c* of the other pair of opposed side edges is positioned adjacent the line of potential folding 25, and is free of securement to the front panel 33, for example, to provide access to the space between the front 22 and back 23**.

As a specific example of the invention, the trimmed, final version of the return envelope (as at 11 in FIG. 2) may have dimensions of 4¾ inches × 7¼ inches. Further, the removal strip or "chip" 20, 21, etc. may have a dimension of ¾ inch (measured in the direction of web travel). The corresponding dimension of the outer envelope may, in such a case, be 5½ inches so that after the "chip" 20 is removed, the resultant final envelope 11 has a ¾ inch less dimension, thereby fitting readily into the outer envelope. By the same token, the return or insert envelopes can be made on the same machinery as the outer envelope because the "repeat" distance is the same, viz., 5½ inches.

The transverse dimension of the outer envelope, in the example just given may be 8 inches, again affording ample space for the receipt of the return envelope 11. Within the 8 inch dimension is normally provided a ½ inch tear-off strip on one side to permit access to the interior of the outgoing envelope and a ¼ inch glue strip on the other — as can be appreciated from a consideration of the above-mentioned U.S. Pat. Nos. 3,777,971 and 3,830,141.

A number of distinct advantages accrue from the practice of the invention. For example, it is possible to place the bottom glue line — i.e., the bands 27 or 37 — quite close to the ultimate bottom of the return envelope because the chip pieces will absorb the overflow so it can be removed later without causing harm. This helps maintain a maximum inside dimension.

The chip is removed normally by cutting portions from each of the front and back panels, resulting in a perfect match and giving improved appearance. The side margins are also trimmed together so that all sides of the finished return envelope have good appearance.

By making the return and outgoing envelopes the same size initially, they can be made at one time on the same machine, with resulting production economy and still get one into the other. Further, the extended portion is not just waste; it is the means to provide for misalignment in manufacture without loss of finished appearance.

Finally, the extension permits the finished cut to be made on material of two thicknesses which is relatively easy and of better quality than if one had to cut one thickness at a location immediately adjacent the edge of the other panel.

As the return envelopes 11 are developed by the removal of the margins 14 and 15 and the chips 21, etc., they are in condition for installation in a series of connected larger envelope assemblies of the form illustrated in the previously referred to patents.

For example, the continuous envelope stream 10 is made at the same time and on the same collating machine as are other printed webs destined to be insert material. All of these webs or plies are unreeled incident to forming the outer envelope, and it is during this manufacture that the trimming and chip removal can be advantageously performed.

I claim:

1. A method of making a return envelope for a stuffed sealed mailer comprising:

advancing an elongated web having a pair of margins at least one of which is defined by a longitudinally extending line of potential trimming with said one margin being equipped with longitudinally spaced, aligned line holes and defining a connected series of front panels between said margins, the major portion of each front panel ultimately constituting the envelope front and flap parts of said return envelope, said flap part being defined relative to said front part by a transversely extending line of potential folding, said flap part ultimately providing one transversely extending edge of said return envelope upon detachment thereof from said web, said envelope front part providing the other transversely extending edge of said detached return envelope, said transversely extending edge of said flap part of a given return envelope being spaced from the transversely extending edge of the envelope front part of an adjacent return envelope, applying a transversely extending band of adhesive to each flap part and front part, the band of adhesive applied to said flap part being adjacent said one transversely extending edge, the band of adhesive applied to said front part being adjacent said other transversely extending edge, applying a pair of longitudinally extending bands of adhesive to said front part adjacent said margins, applying a generally rectangular back panel to each front panel at least the major portion of each back panel constituting the envelope back part, said back panel having longitudinally extending edges generally aligned with said lines of potential trimming with a portion of said back panel adjacent said longitudinally extending edges being secured to said front panel by said longitudinally extending bands of adhesive, said back panel having transversely extending edges, one of said transversely extending edges in each back panel being positioned adjacent said line of potential folding of the associated front panel and unsecured to said front panel, a portion of said back panel adjacent the other said transversely extending edges in said back panel being secured to said front panel by said transversely extending band of adhesive applied to said front part, and completely transversely severing said web by removing a transversely extending strip from each front panel between the transversely extending band of adhesive in one return envelope front part and the transversely extending band of adhesive in the adjacent envelope flap part to provide a series of return envelopes for subsequent installation of said return envelopes in a series of connected larger envelope assemblies.

2. The method of claim 1 in which said back panel overlaps said band of adhesive applied to said front part, said strip removal being achieved by cutting through both said front and back panels.

* * * * *